US008476812B2

(12) United States Patent
Chan et al.

(10) Patent No.: US 8,476,812 B2
(45) Date of Patent: Jul. 2, 2013

(54) SOLID STATE LIGHTING DEVICE WITH IMPROVED HEATSINK

(75) Inventors: Wai Kwan Chan, Hong Kong (CN); Derek Ian Darley, Cromer (AU); Antony Paul Van De Ven, Hong Kong (CN); Gerald H. Negley, Chapel Hill, NC (US)

(73) Assignee: Cree, Inc., Durham, NC (US)

( * ) Notice: Subject to any disclaimer, the term of this patent is extended or adjusted under 35 U.S.C. 154(b) by 109 days.

(21) Appl. No.: 12/498,856

(22) Filed: Jul. 7, 2009

(65) Prior Publication Data

US 2011/0006658 A1 Jan. 13, 2011

(51) Int. Cl.
*H01J 1/02* (2006.01)

(52) U.S. Cl.
USPC ..... 313/45; 455/23

(58) Field of Classification Search
USPC ..... 313/45, 46; 445/23
See application file for complete search history.

(56) References Cited

U.S. PATENT DOCUMENTS

| | | | | |
|---|---|---|---|---|
| 7,224,047 | B2 | 5/2007 | Carberry et al. | |
| 7,456,499 | B2 | 11/2008 | Loh et al. | |
| 7,564,180 | B2 | 7/2009 | Brandes | |
| 2004/0066142 | A1 * | 4/2004 | Stimac et al. | 315/50 |
| 2005/0024834 | A1 * | 2/2005 | Newby | 361/719 |
| 2005/0068776 | A1 * | 3/2005 | Ge | 362/296 |
| 2005/0121172 | A1 | 6/2005 | Lopatinsky | |
| 2006/0227558 | A1 * | 10/2006 | Osawa et al. | 362/351 |
| 2007/0001177 | A1 * | 1/2007 | Bruning et al. | 257/79 |
| 2007/0236935 | A1 * | 10/2007 | Wang | 362/294 |
| 2007/0258240 | A1 * | 11/2007 | Ducharme et al. | 362/231 |
| 2008/0074883 | A1 | 3/2008 | Li | |
| 2008/0211402 | A1 * | 9/2008 | DeCook et al. | 313/511 |
| 2008/0290353 | A1 | 11/2008 | Medendorp, Jr. et al. | |
| 2010/0264795 | A1 * | 10/2010 | Miao | 313/1 |
| 2010/0265717 | A1 * | 10/2010 | Luettgens et al. | 362/294 |

FOREIGN PATENT DOCUMENTS

| | | | |
|---|---|---|---|
| KR | 10-2006-0102796 | A | 9/2006 |
| KR | 10-2008-0096015 | A | 10/2008 |

OTHER PUBLICATIONS

Co-pending U.S. Appl. No. 12/479,318.
Co-pending U.S. Appl. No. 12/535,353.
Davis, J.D., "Copper and Copper Alloys", "ASM International, Handbook Committee", 2001, p. 217.
Groover, M.P., "Fundamentals of Modern Manufacturing: Materials, Processes, and Systems," 4th Ed., "John Wiley & Sons, Inc.", 2010, p. 415.
Ulven Companies Glossary, including definition of undercut, "Accessed online on Feb. 15, 2011 at http://www.ulvencompanies.com/glossary.html".

* cited by examiner

*Primary Examiner* — Anh Mai
*Assistant Examiner* — Andrew Coughlin
(74) *Attorney, Agent, or Firm* — Vincent K. Gustafson; Jenkins, Wilson, Taylor & Hunt, P.A.

(57) ABSTRACT

A solid state lighting device includes at least one emitter and a forged heatsink arranged to receive and dissipate heat generated by emitter(s). The heatsink may have a thickness and/or profile that varies in at least two dimensions. Fabrication of a solid state lighting device may include providing a forged heatsink, and mounting at least one solid state emitter in thermal communication with the heatsink. A space or object may be illuminated with a lighting device including at least one solid state emitter and a forged heatsink. The lighting device may be operated responsive to at least one sensor arranged to sense temperature and/or at least one characteristic of light emitted by the emitter(s).

39 Claims, 6 Drawing Sheets

SOLID STATE LIGHTING DEVICE WITH IMPROVED HEATSINK

FIELD OF THE INVENTION

The present invention relates to solid state lighting devices, and heat transfer structures relating to same.

DESCRIPTION OF THE RELATED ART

Solid state light sources may be utilized to provide white light (e.g., perceived as being white or near-white), and have been investigated as potential replacements for white incandescent lamps. Light perceived as white or near-white may be generated by a combination of red, green, and blue ("RGB") emitters, or, alternatively, by combined emissions of a blue light emitting diode ("LED") and a yellow phosphor. In the latter case, a portion of the blue LED emissions pass through the phosphor, while another portion of the blue LED emissions is "downconverted" to yellow; the combination of blue and yellow light provide a white light. Another approach for producing white light is to stimulate phosphors or dyes of multiple colors with a violet or ultraviolet LED source. A solid state lighting device may include, for example, at least one organic or inorganic light emitting diode and/or laser.

Many modern lighting applications require high power solid state emitters to provide a desired level of brightness. High power solid state emitters can draw large currents, thereby generating significant amounts of heat that must be dissipated. Many solid state lighting systems utilize heatsinks in thermal communication with the heat-generating solid state light sources. For heatsinks of substantial size and/or subject to exposure to a surrounding environment, aluminum is commonly employed as a heatsink material, owing to its reasonable cost, corrosion resistance, and relative ease of fabrication. Aluminum heatsinks for solid state lighting devices are routinely formed in various shapes by casting, extrusion, and/or machining techniques.

Despite the existence of various solid state lighting devices with heatsinks, improvements in heatsinks are still required, for example, to serve the following purposes: (1) to provide enhanced thermal performance; (2) to reduce material requirements; and/or (3) to enable production of various desirable shapes to accommodate solid state lighting devices adapted to different end use applications.

SUMMARY OF THE INVENTION

The present invention relates to solid state lighting devices comprising forged heatsinks, methods of fabricating such devices, and illumination methods utilizing such devices.

In one aspect, the invention relates to a lighting device comprising at least one solid state emitter and a forged heatsink in thermal communication with the at least one solid state emitter.

In another aspect, the invention relates to a method of fabricating a solid state lighting device, the method comprising: providing a forged heatsink; and mounting at least one solid state emitter to the lighting device in thermal communication with the heatsink.

In a further aspect, the invention relates to a method comprising illumination of a space or object utilizing a lighting device comprising at least one solid state emitter and a forged heatsink in thermal communication with the at least one solid state emitter.

In another aspect, the invention relates to a heatsink adapted for use with a solid state lighting device to dissipate heat emanating from at least one solid state emitter, the heatsink comprising a forged body having a thickness and/or profile that varies in at least two dimensions.

In another aspect, the invention relates to a method of fabricating a heatsink adapted for use with a solid state lighting device to dissipate heat emanating from at least one solid state emitter, the method comprising forging of a thermally conductive heatsink material utilizing an impression die forming apparatus including at least two impression dies to vary the thickness and/or profile of the heatsink in at least two dimensions.

In another aspect, any of the foregoing aspects may be combined for additional advantage.

Other aspects, features and embodiments of the invention will be more fully apparent from the ensuing disclosure and appended claims.

DETAILED DESCRIPTION OF THE INVENTION, AND PREFERRED EMBODIMENTS THEREOF

The present invention relates in one aspect to a lighting device comprising at least one solid state emitter and a forged heatsink in thermal communication with the at least one solid state emitter. The present invention further relates to methods of fabricating solid state light emitting devices including forged heatsinks, and methods for illuminating a space or object utilizing a lighting device comprising at least one solid state device and a forged heatsink in thermal communication therewith.

As mentioned previously, solid state lighting devices commonly employ cast, extruded, and/or machined aluminum heatsinks along one or more exposed outer surfaces of such devices. Although casting, extrusion, and machining methods have heretofore been used successfully to produce heatsinks for solid state lighting devices, recent introduction of high power solid state devices and imposition of packaging constraints caused Applicants to investigate alternative designs and fabrication techniques.

Forging is a manufacturing process involving pressing, pounding, or squeezing of metal to produce high density and high strength parts known as forgings. Forging is traditionally used to manufacture high-strength structural parts (e.g., automotive connecting rods, aircraft parts, etc.), as the forgoing process imparts directional strength to parts manufactured thereby. As heatsinks for solid state lighting devices typically do not embody structural parts subject to substantial static or dynamic loading, the enhanced structural integrity imparted by forging has not been necessary for imparting greater strength to these heatsinks.

Forging may be performed hot (e.g., by preheating the metal workpiece to a desired temperature below its melting point before the metal is worked), or cold. Forging is different from the casting (or foundry) process, as metal used to make forged parts is neither melted nor poured—steps that are characteristic of a casting process.

Although styles and drive systems vary, a forging can be produced using equipment such as hammers (which pound metal into shape with controlled high pressure impact blows) and presses (which squeeze metal into shape vertically with controlled high pressure).

Impression die forging involves forming metal to a desired shape and size using preformed impressions (recesses or cavities) in specially prepared dies that exert three-dimensional control on the workpiece. A die is typically formed of material that is harder than the workpiece.

Figure 1A:
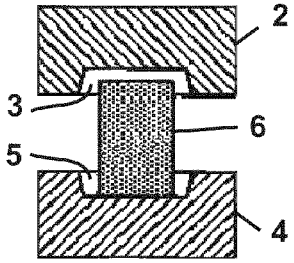
FIG. 1A (RELATED ART)
FIG. 1A is a simplified side cross-sectional view of a first conventional impression die forging apparatus including two dies and a workpiece disposed therebetween, with the dies arranged in a first position.
Figure 1B:
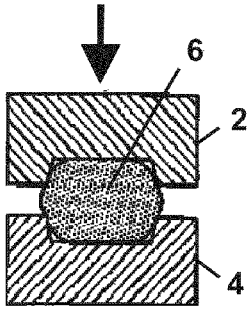
FIG. 1B (RELATED ART)
FIG. 1B is a simplified side cross-sectional view of the forging apparatus of FIG. 1A, with the dies arranged in a second position causing deformation of the workpiece.
Figure 1C:
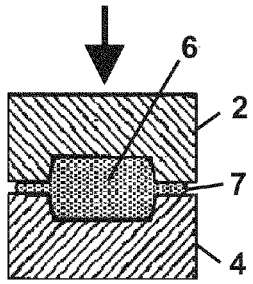
FIG. 1C (RELATED ART)
FIG. 1C is a simplified side cross-sectional view of the forging apparatus of FIGS. 1A-1B, with the dies arranged in a third position causing further deformation of the workpiece.

Examples of conventional apparatuses used for impression die forging are provided in FIGS. 1A-1C and 2. FIG. 1A illustrates a first conventional impression die forging apparatus including two dies 2, 4 each defining an impression or cavity 3, 5, with a workpiece 6 disposed between the dies 2, 4, and with the dies 2, 4 arranged in a first relative position. In FIG. 1B, the upper die 2 is driven downward toward the lower die 4 (in the direction of the illustrated arrow), with the dies 2, 4, illustrated in a second relative position, and the workpiece 6 illustrated in a first state of deformation. As the thickness of the workpiece 6 is reduced, its width expands to fill the impressions 3, 5 defined in the dies 2, 4. In FIG. 1C, the upper die 2 is driven still further downward toward the lower die 4, with the dies 2, 4 illustrated in a third relative position, and the workpiece 6 illustrated in a second state of deformation. A small amount of material 7 begins to flow outside the impressions 3, 5, forming flash that is gradually thinned. The flash cools rapidly and presents increased resistance to deformation and helps build up pressure inside the bulk of the workpiece 6 that aids material flow into any previously unfilled features of the impressions 3, 5.

Figure 2:
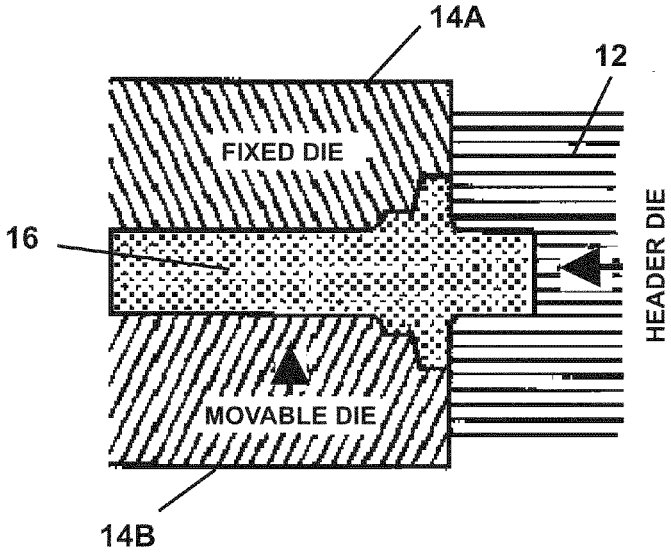
FIG. 2 (RELATED ART)
FIG. 2 is a simplified side cross-sectional view of a second conventional impression die forging apparatus including a header die and a gripper die composed of fixed die and movable die portions, with a workpiece disposed between the header die and the gripper die.
Figure 3:
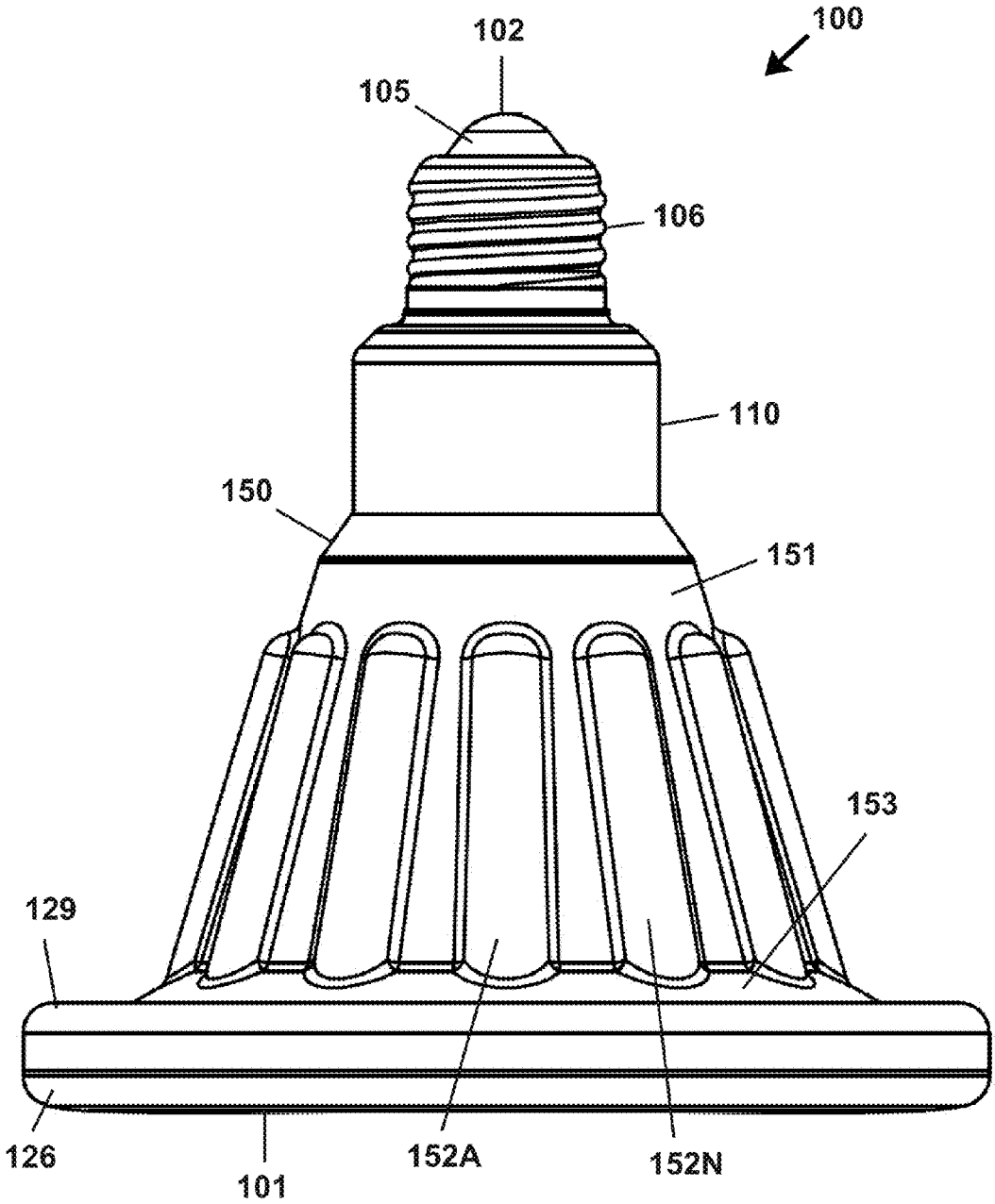
FIG. 3 is a side elevation view of a solid state lighting device according to one embodiment of the present invention.
Figure 4:
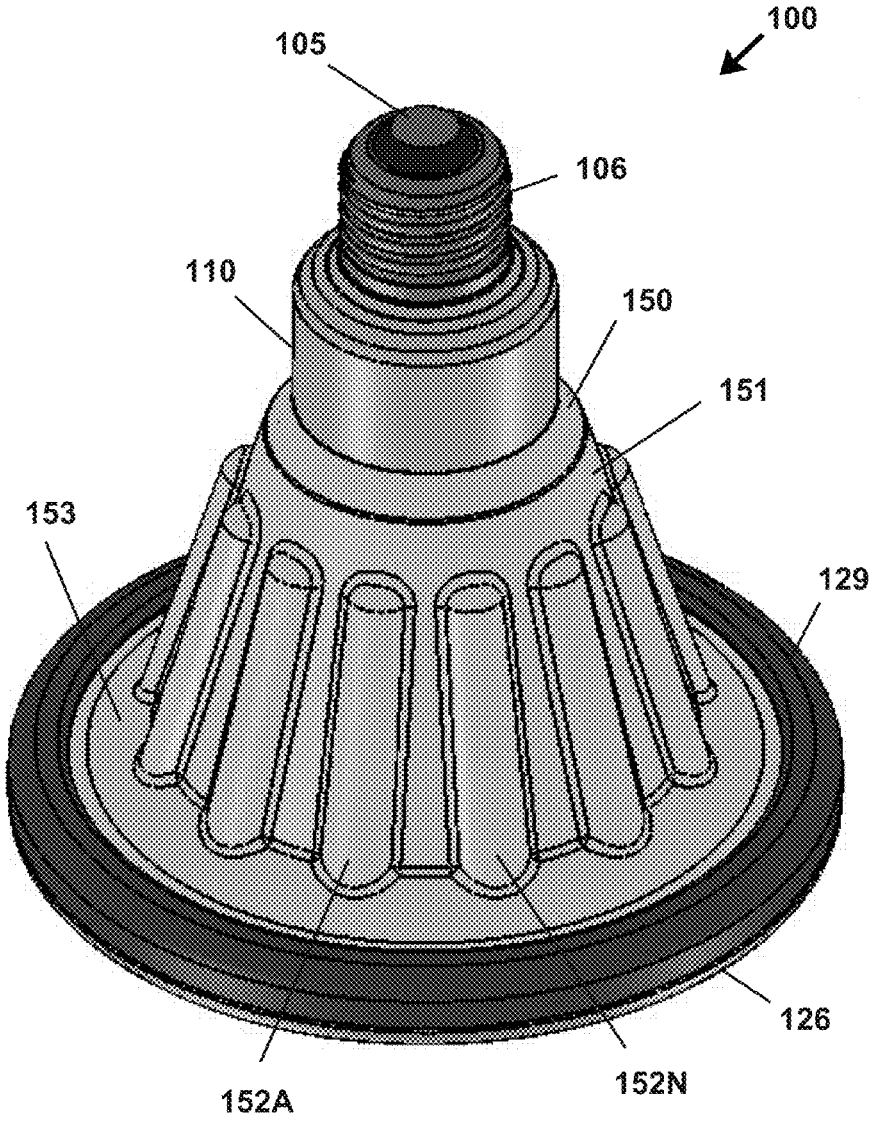
FIG. 4 is an upper perspective view of the solid state lighting device of FIG. 3.
Figure 5:
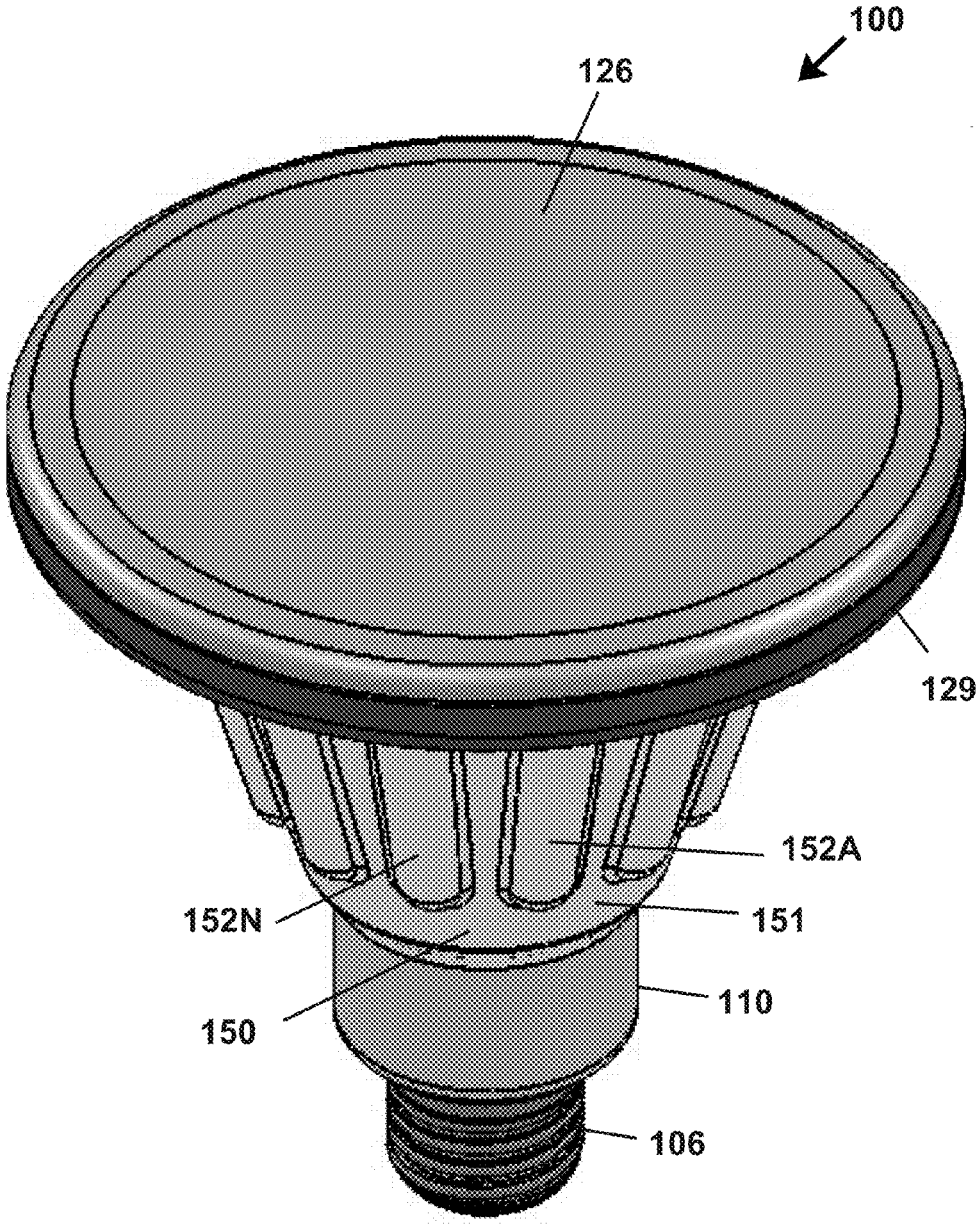
FIG. 5 is a lower perspective view of the solid state lighting device of FIGS. 3-4.
Figure 6:
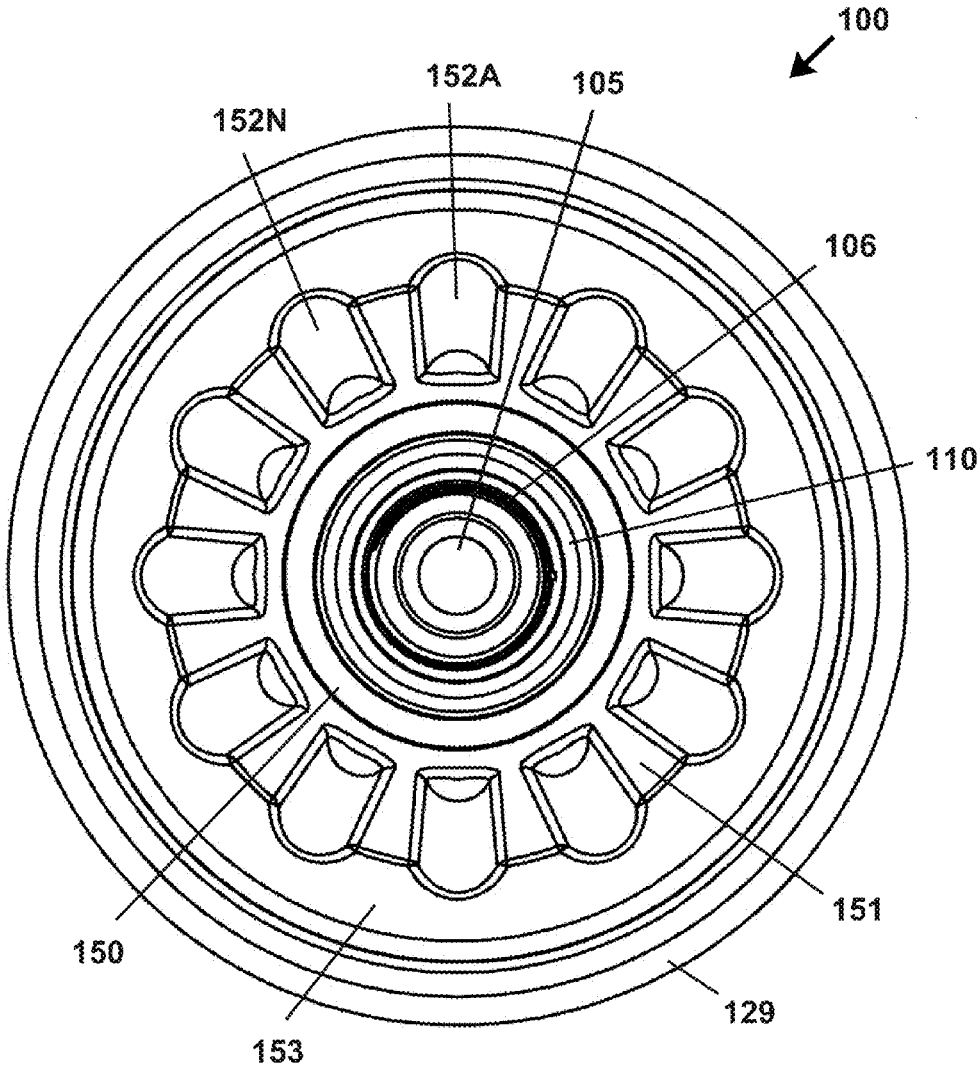
FIG. 6 is a top plan view of the solid state lighting device of FIGS. 3-5.

FIG. 2 illustrates another conventional impression die forging apparatus including a header die 12 and a gripper die 14 composed of a fixed die portion 14A and a movable die portion 14B, with a workpiece 16 disposed between the header die 12 and the gripper die 14. The gripper die 14 is separable along an interface between the fixed die portion 14A and the movable die portion 14B. When the gripper die 14 is closed, to grip the stock (workpiece) and hold it in position for forging. Each of the gripper die 14 and the header die 12 contain impressions. The impression in the ram-operated header die 12 is the equivalent of a hammer or press top die, and the gripper die contains impressions corresponding to the hammer or press bottom die. After each workstroke of the forging apparatus, compressive action exerted by the header die 12 causes the workpiece 16 to fill the impressions defined between the dies 12, 14.

As compared to cast heatsinks for solid state lighting devices, Applicants have found that forged heatsinks offer substantial benefits. A first benefit is greater thermal conductivity, owing to the higher density (lower porosity) of forged heatsinks as compared to cast heatsinks. Cast aluminum heatsinks are typically characterized by a thermal conductivity of about 180 W/m·K. Forged aluminum heatsinks according to embodiments of the present invention desirably may have a thermal conductivity of at least about 180 W/m·K, more preferably at least about 190 W/m·K, still more preferably at least about 200 W/m·K, and even more preferably at least about 210 W/m·K. While pure aluminum has a thermal conductivity of between about 278-300 W/m·K, it is apparent that forged heatsinks provide superior thermal performance over cast heatsinks of the same material.

Benefit of forging over machining for producing heatsinks for solid state lighting devices include making better use of material and generating little scrap, as well as potential for lower cost in high-volume production runs.

As compared to extrusion, forging offers greater flexibility in fabricating heatsinks of widely varying shapes. In one embodiment of the present invention, a forged heatsink has a thickness and/or profile that varies in at least two dimensions. Extrusion alone typically cannot be used to fabricate a heatsink having a thickness and/or profile that varies in at least two dimensions.

A solid state lighting device according to one embodiment of the present invention is illustrated in FIGS. 3-7. The lighting device 100 has a first, light-emitting end 101 and a second end 102

The light-emitting end 101 of the lighting device 100 has a lens 126 (preferably made of an optically transmissive polymeric material) engaged to a cover element 129 disposed around a peripheral lip portion 154 of a forged heatsink 150. The heatsink 150 defines an internal cavity adapted to receive at least a portion of (and preferably the entirety of) the reflector 124, with at least a portion of the heatsink 150 (e.g., the peripheral lip portion 154) having a width greater than a maximum width of the reflector 124. A gap 125 may be provided between the lens 126 and the reflector 124.

Adjacent to the first end 101, at least one solid state emitter 120 is disposed within a cavity defined by a reflector 124 of a suitably reflective material (e.g., polished metal). The reflector 124 may comprise a metal coating over a non-metallic material. In one embodiment, the at least one solid state emitter 120 includes multiple emitters, including light emitting diodes and/or lasers. One or more solid state emitters 120 may be disposed or embodied in a leadframe-based package. Examples of leadframe-based packages are disclosed in U.S. patent application Ser. No. 12,479,318 (entitled "Solid State Lighting Device") and U.S. Provisional Patent Application No. 61/173,466 (entitled "Lighting Device"), which are commonly assigned to the same assignee of the present application, and are hereby incorporated by reference as if set forth fully herein. A solid state emitter package may desirably include a common leadframe, and optionally a common submount to which the emitters may be mounted, with the submount being disposed over the leadframe. A leadframe-based package may include an integral heatsink arranged to conduct heat away from the emitters. One or more emitters may be arranged to white light or light perceived as white. Emitter of various colors may be provided (e.g., whether as emitters or emitter/lumiphor combinations), optionally in conjunction with one or more white light emitters. At least two emitters of a plurality of emitters may have different dominant emission wavelengths. If multiple emitters are provided, the emitters may be operable as a group or operated independently of one another, with each emitter having an electrically conductive control path that is distinct from the electrically conductive control path for another emitter. In one embodiment, multiple solid state emitters are provided, and each emitter is independently controllable relative to other emitters to vary output color emitted by the lighting device. An encapsulant, optionally including at least one luminescent material (e.g., phosphors, scintillators, lumiphoric inks) and/or filter, may be arranged in or on a package containing the solid state emitter(s)

A diffuser dome 121 may be disposed adjacent to a light emitting surface of the at least one solid state emitter 120, to diffuse and/or mix emissions from the at least one solid state emitter 120. The diffuser dome may optionally include one or more luminescent materials.

The at least one emitter 120 may have at least one electrical conductor 130 (e.g., as embodied in a leadframe, submount, or printed circuit board) disposed along a non-emitting surface of the emitter 120. A thermal pad 132 may be disposed between the electrical conductor(s) and a local heat spreader or heatsink 134 (e.g., a slug of copper or other metal). The thermal pad 132 may comprise an electrically insulating but thermally conductive material (e.g., thermally conductive paste) to prevent the local heat spreader or heatsink 134 from being electrically active.

The local heat spreader or heatsink may include an integral heatpipe 135 adapted to facilitate transport of heat away from the at least one emitter 120 toward the first end 101 of the solid state light emitting device 100. A heatpipe is a phase change heat transfer mechanism that can transport heat with a very small difference in temperature between the hotter and colder interfaces. Inside a heatpipe, at the hot interface a fluid turns to vapor and the gas naturally flows and condenses on the colder interface. The liquid falls or is moved by capillary action back to the hot interface to evaporate again and repeat the cycle.

Figure 7:
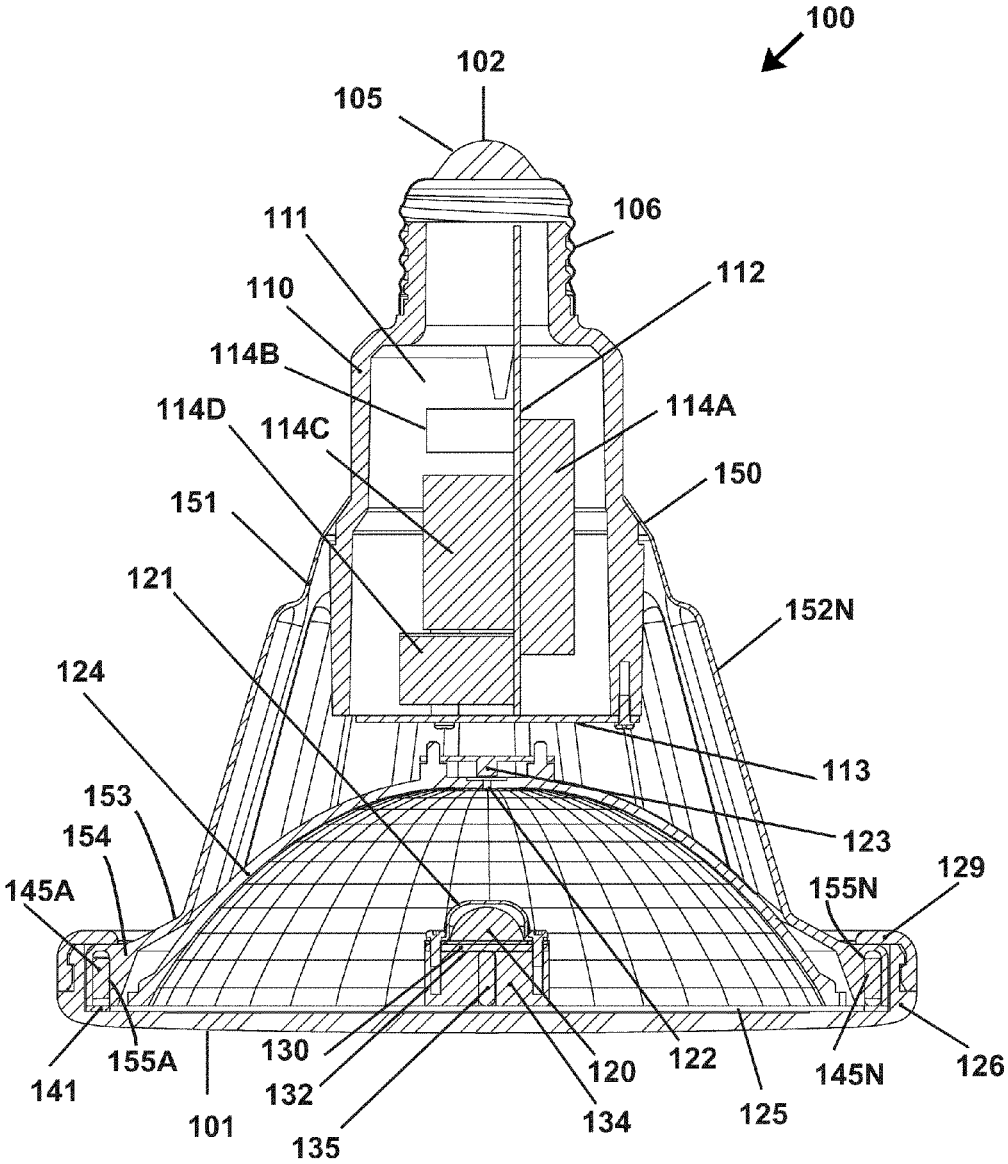
FIG. 7 is a side cross-sectional view of the solid state lighting device of FIGS. 3-6.

Adjacent to the second end 102 of the solid state lighting device 100, electrical connectors 105, 106 are arranged as a screw-type Edison base with a protruding axial connector 105 and a lateral, threaded connector 106 arranged for mating with a threaded socket of a compatible fixture (not shown). The threaded connector 106 is engaged to a housing 110 preferably comprising an electrically insulating material, such as an electrically insulating plastic, ceramic, or composite material. Referring to FIG. 7, disposed within the housing 110 are a longitudinal printed circuit board 112 (which includes conductors in electrical communication with the connectors 105, 106) and power supply elements 114A-114D mounted thereto. A lateral printed circuit board 113 is further engaged with or proximate to the housing 110. The various power supply elements 114A-114D and circuit boards 112, 113 may embody solid state emitter drive control components providing such ballast, color control and/or dimming utilities.

Within the reflector 124 may be arranged at least one sensor 122, which has an associated printed circuit board 123. The sensor(s) 122 may be used to sense one or more characteristics (e.g., intensity, color) of light output by the one or more emitters 120. The sensor 122 may include at least one optical sensor. Multiple sensors 122 may be provided. At least one of the power supply elements 114A-114D may be operated responsive to an output signal from the at least one sensor 122. At least one temperature sensor (not shown) may be further provided adjacent to the emitter(s) 120, the heatsink 150, or any other desired component to sense an excessive temperature condition, and an output signal of the temperature sensor(s) may be used to responsively limit flow of electrical current to the emitter(s) 120, terminate operation of the device 100, and/or trigger an alarm or other warning.

Disposed between the reflector 124 and the housing 110 is a forged heatsink 150, which represents a portion of the exterior of the solid state lighting device 100. The heatsink 150 defines an aperture along one end thereof to mate with an outer surface of the housing 110. The heatsink 150 may be mounted to the housing 110 by any conventional means, including use of adhesives, fasteners, mechanical interlocks, etc.

The heatsink 150 is preferably formed by impression die forging using at least two dies (not shown). At least one impression die may include separable portions. In one embodiment, the forged heatsink 150 is formed of aluminum. In other embodiments, other metals and/or metal alloys may be used. A forged heatsink 150 preferably has a thermal conductivity of at least about 200 W/m·K.

The forged heatsink 150 includes a frustoconical outer surface 151 and a plurality of protrusions 152A-152N that project outward (e.g., radially outward) from the outer surface 151. (Element numbers for each individual protrusion have been omitted from the figures to promote clarity. It is to be understood that any desirable number of protrusions may be provided, with the letter "N" representing a variable indicative of a desired number; this nomenclature is used hereinafter.) As compared to an outer surface 151 lacking such protrusions 152A-152N, the protrusions 152A-152N provide increased surface area to enhance heat dissipation.

Although the protrusions 152A-152N show in FIGS. 3-7 are represented as convex with curved inner surfaces, in alternative embodiments protrusions may be formed in any desirable shape or shapes, including but not limited to solid fins of substantially constant or intentionally varied thickness (e.g., having a thickness that varies from base to tip). In various embodiments, protrusions may be oriented in any desirable direction (e.g., longitudinal (e.g., parallel to a direction from the first end 101 to the second end 102), lateral, or diagonal). Protrusions may be substantially continuous or discontinuous/segmented in type. In one embodiment, a forged heatsink includes a plurality of protrusions (e.g., fins) each having a cross-sectional area that decreases with increasing distance from a center of gravity from the forged heatsink.

The forged heatsink 150 has a profile that varies in at least two dimensions. In one embodiment, the heatsink 150 has a wall thickness that varies in at least two dimensions. In one embodiment, the forged heatsink 150 has a profile that varies in three dimensions. In one embodiment, the heatsink 150 has a wall thickness that varies in three dimensions. Such variations permit area of the heatsink nearest the heat source (e.g., emitter(s)) to be thicker, and areas at the extremities (e.g., farther from the heat source) to be thinner in horizontal and/or vertical profile to maximize heat transfer, and minimize material weight and cost.

The forged heatsink 150 includes a flared transition portion 153 that extends between the frustoconical outer surface 151 and a radial lip 154 of increased thickness relative to the surface 151. The lip 154 preferably defines a plurality of cavities 155A-155N each including an associated heatpipe 145A-145N. The forged heatsink 150 is electrically isolated from the emitter(s) 120. Each heatpipe 145A-145N is arranged to conduct heat from the gap 125 (which is open to the cavity of the reflector 124) into the heatsink 150. The cavities 155A 155N may be formed as part of the process of forging the heatsink 150, or defined after forging by a process such as machining (e.g., drilling). The heatpipes 145A-145N may be inserted into or otherwise formed in the cavities 155A-155N.

The forged heatsink 150 is preferably formed as a single piece, but alternatively may be formed in multiple parts that may be joined together using any suitable joining technique, such as welding, brazing, and the like.

In operation of the solid state light emitting device 100, electrical current is delivered through the connectors 105, 106 to the longitudinal circuit board 112, associated components 114A-114D, and lateral circuit board 113. Conductive traces, wires, and/or other conductors (not shown) may be used to supply current to the solid state emitter(s) 120. Light from the emitter(s) travels through the diffuser 121 to the reflector 124, which reflects at least a portion of light emitted from the solid state emitter(s) 120 toward the first end 101 to travel through the lens 126 and exit the device 100. Heat from the emitter(s) and/or the reflector 124 is radiated into the reflector cavity 124 and also conducted through the conductive slug 134 (aided by the central heatsink 135). Heat from the cavity 124 and gap 125 is received by the radial lip 154, aided by operation of the lateral heatpipes 145A-145N, and conducted into the frustoconical outer surface 151 and protrusions 152A-152N to be dissipated into an environment (e.g., air within such an environment) proximate to the lighting device 100. The forged heatsink 150 is therefore in thermal communication with the emitter(s) 120 by way of intermediate heat transfer components. Optionally, a flow of air or other cooling fluid may be directed against the outer surface 151 and protrusions 152A-152N to promote convective cooling. Such flow of fluid may be generated by operating a cooling device (e.g., a fan, a pump, etc.) in thermal communication with the forged heatsink to cool the heatsink.

One embodiment includes a lamp including at least one solid state lighting device 100 as disposed herein. Another embodiment includes a light fixture including at least one solid state lighting device 100 as disposed herein. In one embodiment, a light fixture includes a plurality of solid state lighting devices. In one embodiment, a light fixture is arranged for recessed mounting in ceiling, wall, or other surface. In another embodiment, a light fixture is arranged for track mounting.

In one embodiment, an enclosure comprises an enclosed space and at least one lighting device 100 as disclosed herein, wherein upon supply of current to a power line, the at least one lighting device illuminates at least one portion of the enclosed space. In another embodiment, a structure comprises a surface or object and at least one lighting device as disclosed herein, wherein upon supply of current to a power line, the lighting device illuminates at least one portion of the surface or object. In another embodiment, a lighting device as disclosed herein may be used to illuminate an area comprising at least one of the following: a swimming pool, a room, a warehouse, an indicator, a road, a vehicle, a road sign, a billboard, a ship, a toy, an electronic device, a household or industrial appliance, a boat, and aircraft, a stadium, a tree, a window, a yard, and a lamppost.

It is to be appreciated that any of the elements and features described herein may be combined with any one or more other elements and features.

While the invention has been has been described herein in reference to specific aspects, features and illustrative embodiments of the invention, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Correspondingly, the invention as hereinafter claimed is intended to be broadly construed and interpreted, as including all such variations, modifications and alternative embodiments, within its spirit and scope.

What is claimed is:

1. A lighting device comprising a light bulb including:

at least one solid state emitter; and an impression die-forged heatsink in conductive thermal communication with the at least one solid state emitter;

wherein at least a portion of the heatsink comprises a cavity arranged to receive the at least one solid state emitter and arranged to receive at least a portion of at least one solid state emitter drive control component in electrical communication with the at least one solid state emitter, wherein the at least one solid state emitter drive control component provides at least one of ballast utility, color control utility, and dimming utility;

wherein at least a portion of the heatsink is exposed along an exterior surface of the light bulb; and wherein at least a portion of the impression die-forged heatsink comprises a substantially frustoconical shape.

2. The lighting device of claim 1, wherein the impression die-forged heatsink has a wall thickness that varies in at least two dimensions.

3. The lighting device of claim 1, wherein the impression die-forged heatsink comprises a plurality of integrally formed forged protrusions arranged to aid in dissipating heat.

4. The lighting device of claim 3, wherein the plurality of integrally formed protrusions comprises a plurality of convex protrusions with curved inner surfaces.

5. The lighting device of claim 1, wherein the impression die-forged heatsink has a thermal conductivity of at least about 200 W/(m K).

6. The lighting device of claim 1, wherein the at least one solid state emitter drive control component comprises a ballast.

7. The lighting device of claim 1, comprising a reflector arranged to reflect at least a portion of light emitted by the at least one solid state emitter, wherein at least a portion of the reflector is received by the cavity.

8. The lighting device of claim 1, wherein the at least one solid state emitter is adapted to emit white light.

9. The lighting device of claim 1, wherein the at least one solid state emitter comprises a plurality of solid state emitters.

10. The lighting device of claim 9, wherein each solid state emitter of the plurality of solid state emitters is independently controllable.

11. The lighting device of claim 1, wherein the impression die-forged heatsink is electrically isolated from the at least one solid state emitter.

12. The lighting device of claim 1, further comprising a lens arranged to transmit at least a portion of light emitted by the at least one solid state emitter.

13. The lighting device of claim 1, further comprising at least one luminescent material arranged to receive light emitted by at least one solid state emitter, and to responsively re-emit light of a different dominant wavelength than the light emitted by the at least one solid state emitter.

14. The lighting device of claim 1, further comprising at least one heatpipe arranged within at least a portion of the impression die-forged heatsink.

15. A lamp or light fixture comprising the lighting device of claim 1.

16. A method comprising illumination of a space or object utilizing a lighting device according to claim 1.

17. The method of claim 16, further comprising dissipating heat from the heatsink to air within an environment proximate to the lighting device.

18. The method of claim 16, wherein the at least one solid state emitter is adapted to emit white light.

19. The method of claim 16, wherein the at least one solid state emitter comprises a plurality of solid state emitters, and the method further comprises independently operating each emitter of the plurality of emitters.

20. The method of claim 19, wherein the plurality of solid state emitters includes emitters having different dominant emission wavelengths, and the method further comprises independently controlling at least two emitters of the plurality of emitters to vary output color emitted by the lighting device.

21. The method of claim 16, further comprising operating a cooling device in thermal communication with the forged heatsink to cool the forged heatsink.

22. A method of fabricating a heatsink adapted for use with a solid state lighting device according to claim 1 to dissipate heat emanating from at least one solid state emitter, the method comprising forging of a thermally conductive heatsink material utilizing an impression die forging apparatus including at least two impression dies to vary the thickness and/or profile of the heatsink in at least two dimensions.

23. The lighting device of claim 1, wherein the at least one solid state emitter comprises a plurality of solid state emitters, and each solid state emitter of the plurality of solid state emitters is arranged within the cavity.

24. The lighting device of claim 1, further comprising at least one printed circuit board, wherein the at least one solid state emitter drive control component is mounted to the at least one printed circuit board and at least a portion of the at least one printed circuit board is arranged within the cavity.

25. The lighting device of claim 24, wherein the lighting device comprises a base end and a light emitting end, and the at least one printed circuit board is arranged with at least one face extending substantially parallel to a direction extending from the base end to the light emitting end.

26. The light emitting device of claim 1, wherein the at least one solid state emitter drive control component provides any of color control utility and dimming utility.

27. A method of fabricating a solid state lighting device according to claim 1, the method comprising:

providing an impression die-forged heatsink, wherein at least a portion of the heatsink comprises a cavity arranged to receive the at least one solid state emitter, and wherein at least a portion of the cavity of the forged heatsink comprises a substantially frustoconical shape;

mounting the at least one solid state emitter drive control component with at least a portion of the at least one emitter drive control component arranged in the cavity; and mounting at least one solid state emitter to the lighting device in the cavity, in electrical communication with the at least one solid state emitter drive control component and in thermal communication with the heatsink.

28. The method of claim 27, wherein providing the impression die-forged heatsink comprises forging of a thermally conductive heatsink material utilizing an impression die forging apparatus including at least two impression dies.

29. The method of claim 28, wherein said forging includes formation of a plurality of outward protrusions.

30. The method of claim 27, wherein providing the impression die-forged heatsink comprises forging of a thermally conductive heatsink material to vary a wall thickness of the heatsink in at least two dimensions.

31. The method of claim 30, wherein at least some protrusions of the plurality of protrusions have a cross-sectional area that decreases with increasing distance from a center of gravity from the impression die-forged heatsink.

32. The method of claim 27, further comprising arranging at least one heatpipe in at least a portion of the impression die-forged heatsink.

33. The method of claim 27, further comprising mounting a reflector with at least a portion of the reflector within the cavity, wherein the reflector is arranged to reflect at least a portion of light emitted by the at least one solid state emitter.

34. A heatsink adapted for use with a solid state light bulb to dissipate heat emanating from at least one solid state emitter, the heatsink comprising an impression die-forged body having a thickness and/or profile that varies in at least two dimensions, wherein at least a portion of the heatsink is arranged to be exposed along an exterior surface of the solid state light bulb, at least a portion of the heatsink comprises a cavity arranged to receive the at least one solid state emitter and to receive at least a portion of at least one solid state emitter drive control component providing at least one of ballast utility, color control utility, and dimming utility, and at least a portion of the cavity of the heatsink comprises a substantially frustoconical shape.

35. The heatsink of claim 34, comprising a plurality of integrally formed forged protrusions arranged to aid in dissipating heat.

36. The lighting device of claim 35, wherein the plurality of integrally formed protrusions comprises a plurality of convex protrusions with curved inner surfaces.

37. The heatsink of claim 34, having a thermal conductivity of at least about 200 W/(m K).

38. The heatsink of claim 34, comprising at least one heatpipe formed within at least a portion of the heatsink.

39. The heatsink of claim 34, wherein the internal cavity is adapted to receive at least a portion of a reflector arranged to reflect light emitted by at least one solid state emitter in thermal communication with the heatsink.

* * * * *

UNITED STATES PATENT AND TRADEMARK OFFICE

CERTIFICATE OF CORRECTION

PATENT NO. : 8,476,812 B2
APPLICATION NO. : 12/498856
DATED : July 2, 2013
INVENTOR(S) : Chan et al.

It is certified that error appears in the above-identified patent and that said Letters Patent is hereby corrected as shown below:

In the Specification

At column 3, lines 55-56: "When the gripper die 14 is closed" should be -- Then the gripper die 14 is closed --.

At column 4, line 13: "Benefit of forging" should be -- Benefits of forging --.

At column 4, lines 58-59: "Emitter of various colors" should be -- Emitters of various colors --.

At column 7, line 35: "arranged for recessed mounting in ceiling" should be -- arranged for recessed mounting in a ceiling --.

At column 7, line 51: "a boat, and aircraft, a stadium" should be -- a boat, an aircraft, a stadium --.

In the Claims

At column 9, line 34 (claim 26): "The light emitting device of claim 1" should be -- The lighting device of claim 1 --.

At column 10, line 40 (claim 36): "The lighting device of claim 35" should be -- The heatsink of claim 35 --.

At column 10, line 47 (claim 47): "the internal cavity is" should be -- the cavity is --.

Signed and Sealed this
Thirty-first Day of December, 2013

Margaret A. Focarino

Margaret A. Focarino
*Commissioner for Patents of the United States Patent and Trademark Office*